US007979229B2

(12) United States Patent
Otaka et al.

(10) Patent No.: US 7,979,229 B2
(45) Date of Patent: Jul. 12, 2011

(54) DISPLACEMENT CONTROL SIGNAL CORRECTION METHOD, DISPLACEMENT CONTROL DEVICE, CONSTRUCTION MACHINE AND DISPLACEMENT CONTROL SIGNAL CORRECTION PROGRAM

(75) Inventors: Saimon Otaka, Tsukuba (JP); Yoshinori Ohwada, Niihari-gun (JP); Gen Yasuda, Niihari-gun (JP); Kenji Kakizawa, Tsuchiura (JP)

(73) Assignee: Hitachi Construction Machinery Co., Ltd., Tokyo (JP)

( * ) Notice: Subject to any disclaimer, the term of this patent is extended or adjusted under 35 U.S.C. 154(b) by 560 days.

(21) Appl. No.: 10/594,083

(22) PCT Filed: Feb. 18, 2005

(86) PCT No.: PCT/JP2005/002578

§ 371 (c)(1),
(2), (4) Date: Sep. 25, 2006

(87) PCT Pub. No.: WO2005/100793

PCT Pub. Date: Oct. 27, 2005

(65) Prior Publication Data

US 2007/0193263 A1 Aug. 23, 2007

(30) Foreign Application Priority Data

Mar. 26, 2004 (JP) ..... 2004-091228

(51) Int. Cl.
*G01L 27/00* (2006.01)

(52) U.S. Cl. ..... 702/98

(58) Field of Classification Search ..... 702/45, 702/47, 50, 94, 98, 100, 105, 150, 155, 95
See application file for complete search history.

(56) References Cited

U.S. PATENT DOCUMENTS

| | | | | |
|---|---|---|---|---|
| 5,179,330 | A | 1/1993 | Nikolaus | |
| 5,553,481 | A * | 9/1996 | Arai | 73/1.66 |
| 5,832,730 | A * | 11/1998 | Mizui | 60/469 |
| 6,101,456 | A * | 8/2000 | Kowatari et al. | 702/105 |
| 6,192,299 | B1 * | 2/2001 | Kubota et al. | 700/282 |
| 6,671,641 | B1 * | 12/2003 | Collins et al. | 702/105 |

FOREIGN PATENT DOCUMENTS

| | | | |
|---|---|---|---|
| JP | 03-149602 | A | 6/1991 |
| JP | 04-220701 | A | 8/1992 |
| JP | 06-307409 | A | 11/1994 |
| JP | 08-302755 | A | 11/1996 |
| JP | 11-303760 | A | 11/1999 |
| JP | 11-311203 | A | 11/1999 |

OTHER PUBLICATIONS

International Search Report dated Mar. 22, 2005. (One (1) page).

* cited by examiner

*Primary Examiner* — Cindy Hien-Dieu Khuu
(74) *Attorney, Agent, or Firm* — Crowell & Moring LLP

(57) ABSTRACT

The present invention includes: a displacement altering unit for generating a displacement control pressure corresponding to a displacement control signal; an input unit for inputting a target displacement; a pressure calculating unit for calculating a displacement control pressure corresponding to the target displacement based upon predetermined reference characteristics of the displacement altering unit; a pressure detecting unit for detecting a pressure corresponding to the displacement control pressure; a signal calculating unit for calculating a displacement control signal corresponding to the input target displacement; and a correcting unit for correcting the displacement control signal calculated by the signal calculating unit based upon the displacement control pressure having been calculated by the pressure calculating unit and the measured pressure detected by the pressure detecting unit.

4 Claims, 15 Drawing Sheets

DISPLACEMENT CONTROL SIGNAL CORRECTION METHOD, DISPLACEMENT CONTROL DEVICE, CONSTRUCTION MACHINE AND DISPLACEMENT CONTROL SIGNAL CORRECTION PROGRAM

TECHNICAL FIELD

The present invention relates to a displacement control signal correction method for correcting the pump displacement or the like of a hydraulic pump, a displacement control device, a construction machine and a displacement control signal correction program.

BACKGROUND ART

There are devices known in the related art that control a pump displacement by driving a proportional electromagnetic valve based upon a displacement control signal corresponding to the extent to which an operation lever is operated, output to the proportional electromagnetic valve (see, for instance, Patent Reference Literature #1). In order to account for any inconsistency in the control characteristics that may exist among individual proportional electromagnetic valves, such a control device controls the proportional electromagnetic valve based upon a correction expression to be used for pump displacement correction determined in correspondence to the deviation of the actual pump displacement relative to a target pump displacement.

Patent Reference Literature 1: Japanese Laid Open Patent Publication No. H8-302755

DISCLOSURE OF THE INVENTION

Problems to be Solved by the Invention

In the device disclosed in Patent Reference Literature #1, the pump displacement correction expression is determined in correspondence to the deviation of the actual pump displacement relative to the target pump displacement, and thus, the device requires a pump displacement angle sensor for detecting the actual pump displacement. However, the price of the control device equipped with an expensive pump displacement angle sensor is bound to increase significantly.

Means for Solving the Problems

A displacement control signal correction method according to the present invention achieves a displacement control signal correction method for correcting a displacement control signal output based upon predetermined reference characteristics of a displacement altering means, comprising: calculating a displacement control pressure corresponding to a reference displacement based upon the reference characteristics and determining correction pressure characteristics based upon a difference between the displacement control pressure and a corresponding measured pressure; and calculating a correction pressure corresponding to a target displacement based upon the correction pressure characteristics and correcting the displacement control signal in correspondence to the correction pressure.

Also, a displacement control signal correction method according to the present invention for correcting a displacement control signal output based upon predetermined reference characteristics of a displacement altering means, comprises: calculating a displacement control pressure corresponding to a target displacement based upon the reference characteristics and correcting the displacement control signal through feedback control so as to reduce a difference between the displacement control pressure and a corresponding measured pressure.

3. Further, a displacement control signal correction method according to the present invention for correcting a displacement control signal output based upon predetermined reference characteristics of a displacement altering means, comprises: setting in advance a reference displacement control signal and a reference displacement control pressure corresponding to a reference displacement based upon the reference characteristics, ascertaining a relationship between a predetermined displacement control signal and a pressure measured when the displacement control signal is output, calculating a displacement control signal needed to generate the reference displacement control pressure based upon the relationship having been ascertained, and calculating a difference between the displacement control signal and the reference displacement control signal; and correcting a displacement control signal output in correspondence to a target displacement based upon the difference having been calculated.

A displacement control device according to the present invention comprises: a displacement altering means for generating a displacement control pressure corresponding to a displacement control signal; an input means for inputting a target displacement; a pressure calculating means for calculating a displacement control pressure corresponding to the target displacement based upon predetermined reference characteristics of the displacement altering means; a pressure detecting means for detecting a pressure corresponding to the displacement control pressure; and a correcting means for correcting a displacement control signal corresponding to the target displacement input through the input means based upon the displacement control pressure having been calculated by the pressure calculating means and the measured pressure detected by the pressure detecting means.

It is preferred that the correcting means corrects the displacement control signal based upon the displacement control pressure having been calculated by the pressure calculating means, a first measured pressure corresponding to a minimum displacement, which is detected while increasing the displacement, and a second measured pressure corresponding to a maximum displacement, which is detected while decreasing the displacement.

The correcting means may include: a pressure characteristics setting means for setting correction pressure characteristics corresponding to the target displacement based upon a difference between the displacement control pressure having been calculated by the pressure calculating means and the measured pressure detected by the pressure detecting means; and a correction pressure calculating means for calculating a correction pressure corresponding to the target displacement input through the input means based upon the correction pressure characteristics, and correct the displacement control signal so as to adjust an actual displacement to the target displacement in correspondence to the correction pressure having been calculated.

The correcting means can correct the displacement control signal through feedback control so as to decrease a difference between the displacement control pressure having been calculated by the pressure calculating means and the measured pressure detected by the pressure detecting means.

A displacement control device according to the present invention comprises: a displacement altering means for generating a displacement control pressure corresponding to a displacement control signal; an input means for inputting a target displacement; a pressure detecting means for detecting a pressure corresponding to the displacement control pressure; a signal output means for outputting a displacement control signal corresponding to the target displacement to the displacement altering means based upon predetermined reference characteristics of the displacement altering means; a setting means for setting a reference displacement control signal and a reference displacement control pressure corresponding to a reference displacement, based upon the reference characteristics; and a correcting means for calculating a displacement control signal needed to generate the reference displacement control pressure based upon a measured pressure detected by the pressure detecting means when the displacement control signal is output by the signal output means, calculating a difference between the displacement control signal and the reference displacement control signal and correcting the displacement control-signal output to the displacement altering means based upon the difference having been calculated.

It is preferred that the correcting means calculates a displacement control signal needed to generate the reference displacement control pressure based upon a first measured pressure corresponding to a minimum displacement, which is detected by the pressure detecting means while increasing the displacement, and a second measured pressure corresponding to a maximum displacement, which is detected while decreasing the displacement.

The displacement control device can further comprise a filtering means for filtering a detection value provided by the pressure detecting means so as to eliminate a vibration component from the measured pressure.

It is preferred that any of the displacement control devices is applied to a construction machine.

A program according to the present invention achieves a program that enables a computer to execute processing for correcting a displacement control signal output based upon predetermined reference characteristics of a displacement altering means, comprising: processing for calculating a displacement control pressure corresponding to a reference displacement based upon the reference characteristics and determining correction pressure characteristics based upon a difference between the displacement control pressure and a corresponding measured pressure; and processing for calculating a correction pressure corresponding to a target displacement based upon the correction pressure characteristics and correcting the displacement control signal in correspondence to the correction pressure.

A program according to the present invention achieves a program that enables a computer to execute processing for correcting a displacement control signal output based upon predetermined reference characteristics of a displacement altering means, comprising: processing for calculating a displacement control pressure corresponding to a target displacement based upon the reference characteristics and correcting the displacement control signal through feedback control so as to reduce a difference between the displacement control pressure and a corresponding measured pressure.

A program according to the present invention achieves a program that enables a computer to execute processing for correcting a displacement control signal output based upon predetermined reference characteristics of a displacement altering means, comprising: processing for setting in advance a reference displacement control signal and a reference displacement control pressure corresponding to a reference displacement based upon the reference characteristics, ascertaining a relationship between a predetermined displacement control signal and a pressure measured when the displacement control signal is output, calculating a displacement control signal needed to generate the reference displacement control pressure based upon the relationship having been ascertained and calculating a difference between the displacement control signal and the reference displacement control signal; and processing for correcting a displacement control signal output in correspondence to a target displacement based upon the difference having been calculated.

Effect of the Invention

According to the present invention, a displacement control signal output to the displacement altering means is corrected based upon the displacement control pressure calculated in correspondence to a target displacement and the actually measured pressure, or based upon the relationship between a predetermined reference displacement control signal and the actual pressure measured in correspondence to the reference displacement control signal. Thus, accurate displacement control can be executed without having to utilize a displacement angle sensor, which makes it possible to provide an inexpensive displacement control device.

The structure of the displacement control device achieved in a first embodiment of the present invention.

[FIG. 2]

A side elevation of a hydraulic excavator in which the present invention may be adopted.

[FIG. 3]

Figure 1:
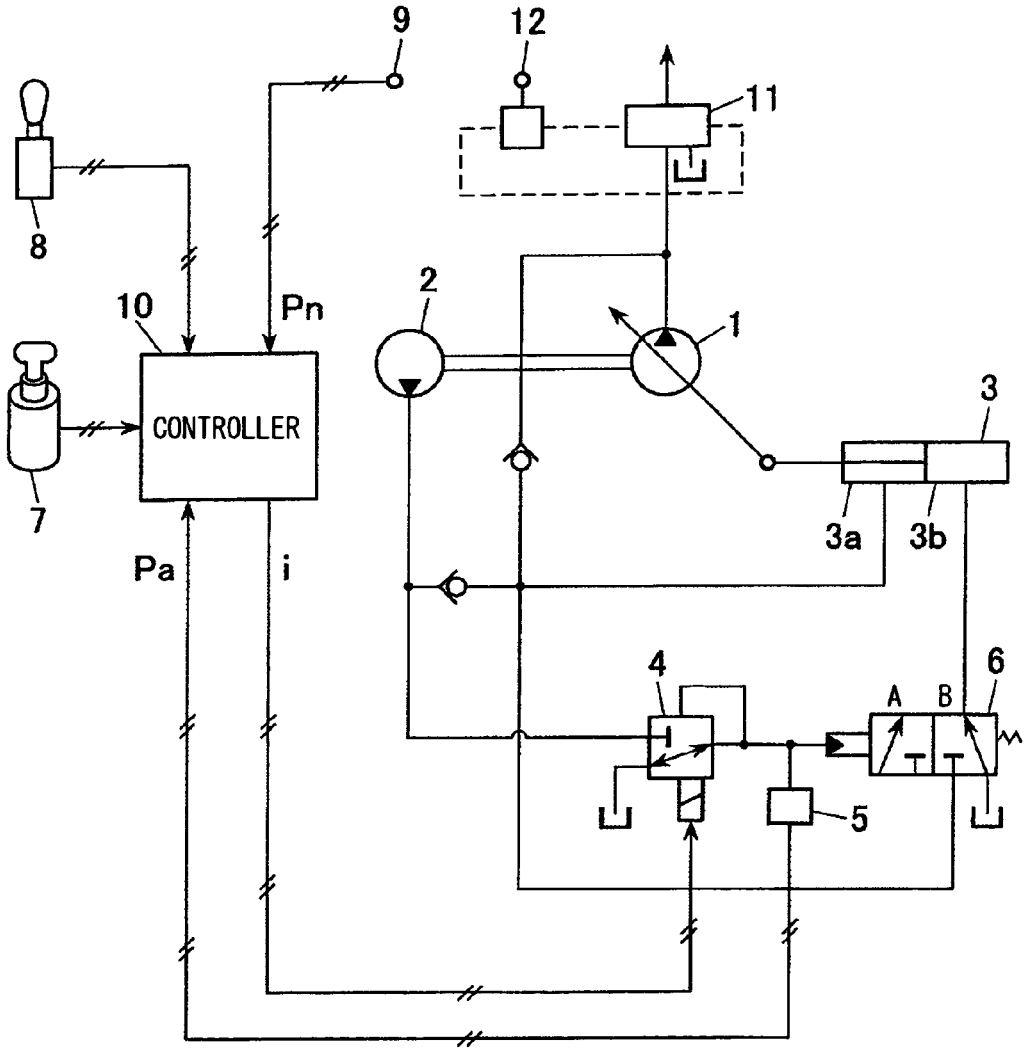
[FIG. 1]

A diagram of the characteristics of the proportional electromagnetic valve in FIG. 1.

[FIG. 4]

The relationship between the command pressure at the proportional electromagnetic valve and the pump displacement.

[FIG. 5]

A flowchart of an example of processing that may be executed in the controller in the first embodiment.

[FIG. 6]

Figure 5:
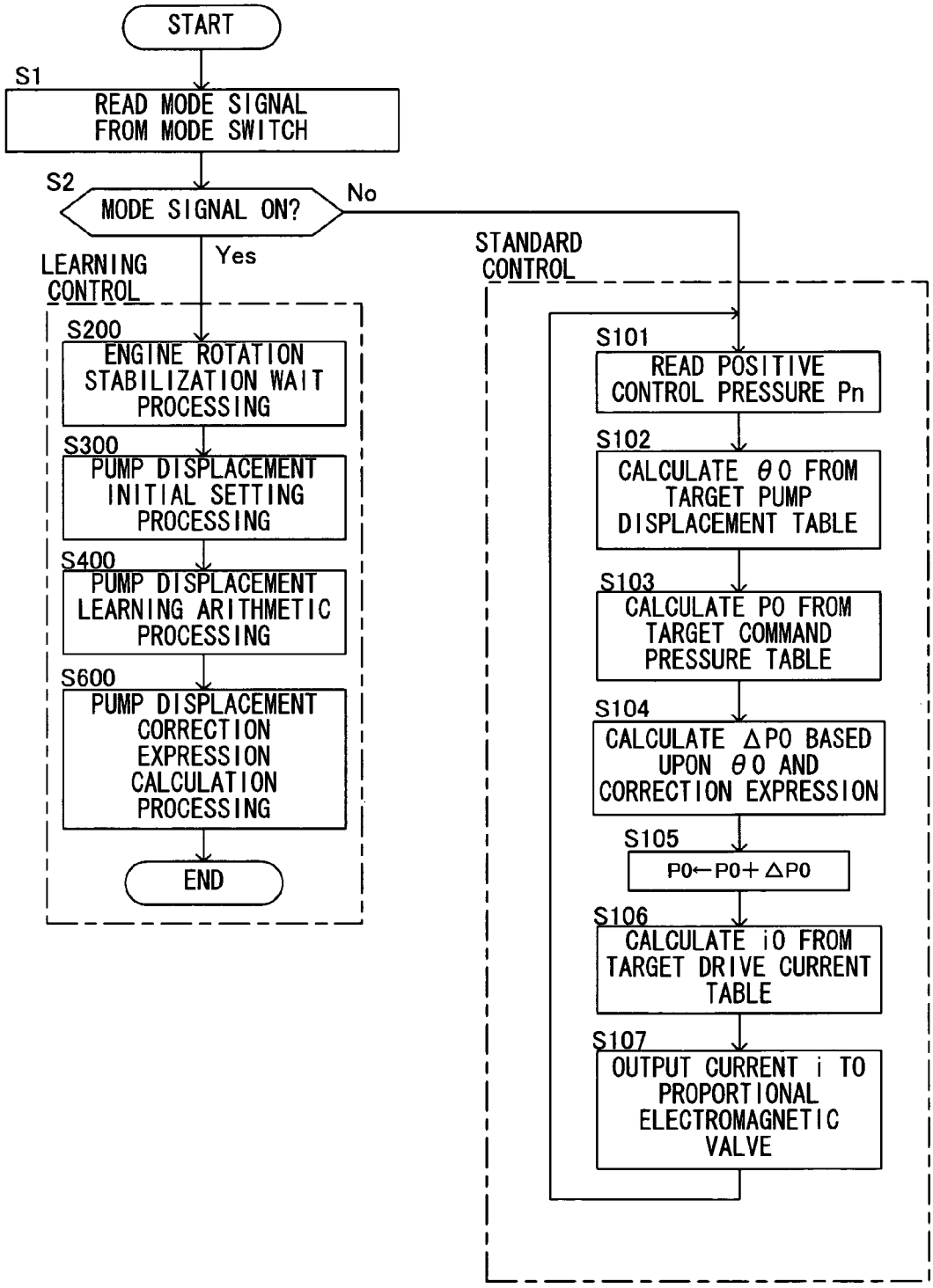

A detailed flowchart of the pump displacement learning arithmetic processing in FIG. 5.

[FIG. 7]

Figure 6:
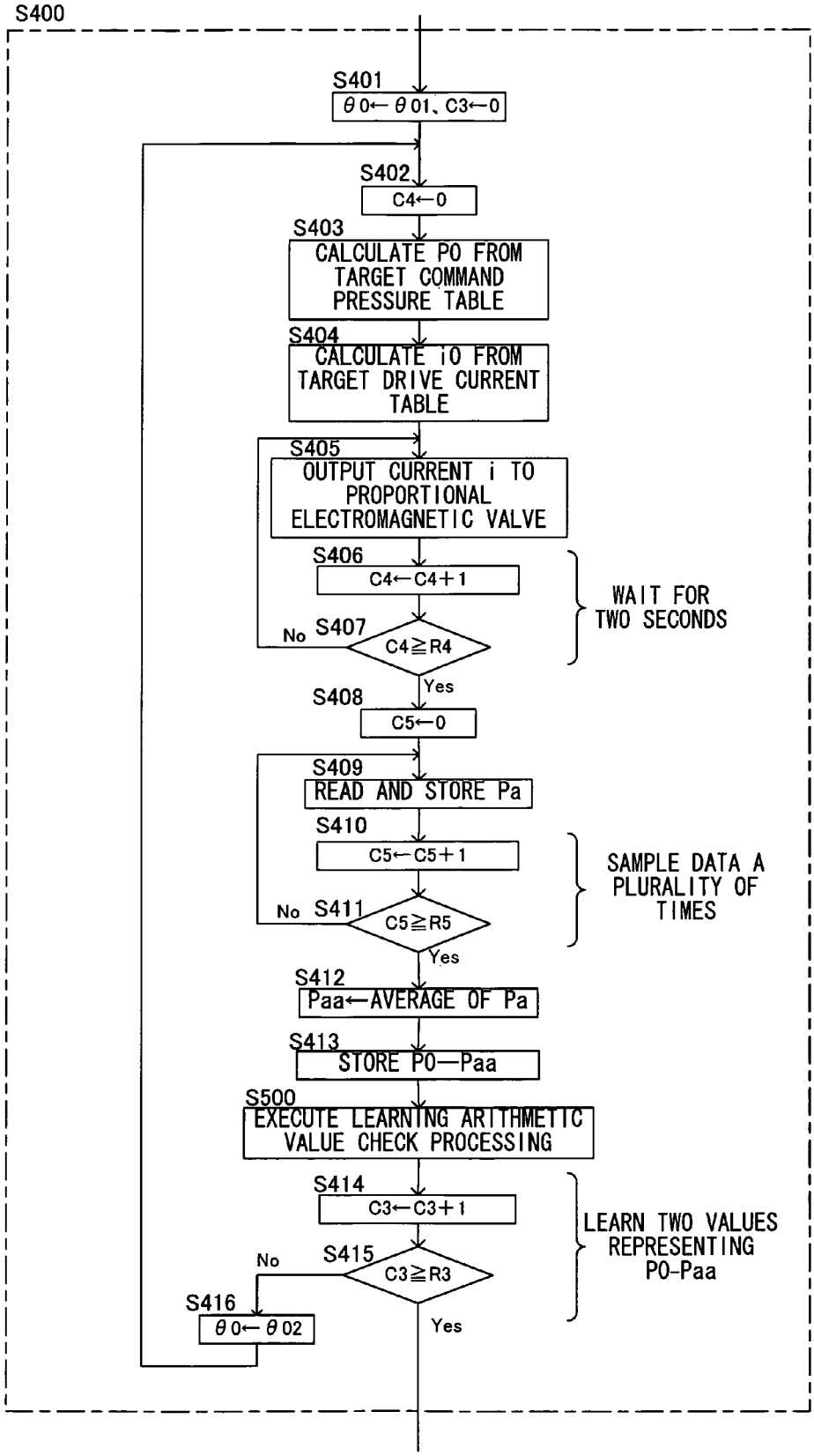

A detailed flowchart of the learning arithmetic value check processing in FIG. 6.

[FIG. 8]

A detailed flowchart of the pump displacement correction expression calculation processing in FIG. 5.

[FIG. 9]

The relationship of the target command pressure to the target pump displacement achieved in the present invention.

[FIG. 10]

The relationship of the target drive current to the target command pressure observed in the present invention.

[FIG. 11]

The relationship of the correction pressure to the target pump displacement observed in the present invention.

[FIG. 12]

The relationship of the target pump displacement to the positive control pressure observed in the present invention.

[FIG. 13]

A block diagram of the processing executed in the controller in a second embodiment.

[FIG. 14]

A flowchart of an example of processing (learning processing) that may be executed in the controller in a third embodiment.

[FIG. 15]

A flowchart of an example of processing (regular processing) that may be executed in the controller in the third embodiment.

[FIG. 16]

A flowchart of an example of processing (sampling processing) that may be executed in the controller in the third embodiment.

[FIG. 17]

The relationship between the secondary pressure at the proportional electromagnetic valve and the drive current.

[FIG. 18]

A diagram of the reference characteristics with regard to the pump displacement and the current.

[FIG. 19]

Figure 18:
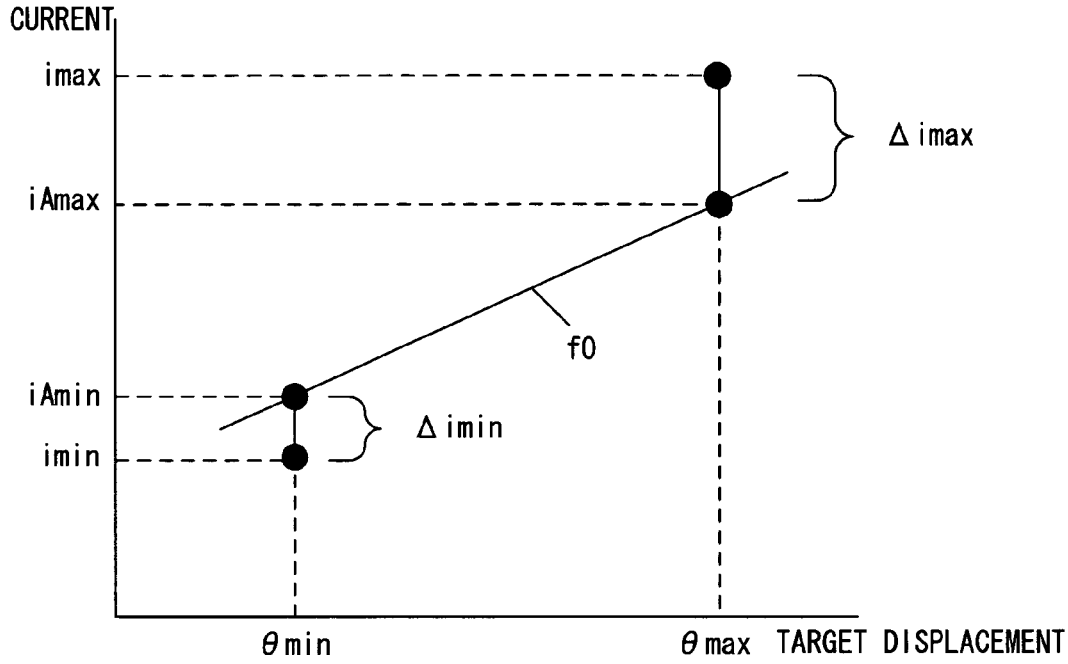

The relationship between the reference characteristics in FIG. 18 and the correction characteristics.

[FIG. 20]

The current pressure characteristics of the proportional electromagnetic valve achieved in a fourth embodiment. and

[FIG. 21]

The timing chart of the learning control executed by the displacement control device in the fourth embodiment.

EXPLANATION OF REFERENCE NUMERALS

2 hydraulic pump
4 proportional electromagnetic valve
5 pressure sensor (secondary pressure Pa)
9 pressure sensor (positive control pressure Pn)
10 controller
12 operation lever

BEST MODE FOR CARRYING OUT THE INVENTION

First Embodiment

The following is an explanation of the first embodiment of the displacement control device according to the present invention given in reference to FIGS. 1 through 12.

Figure 2:
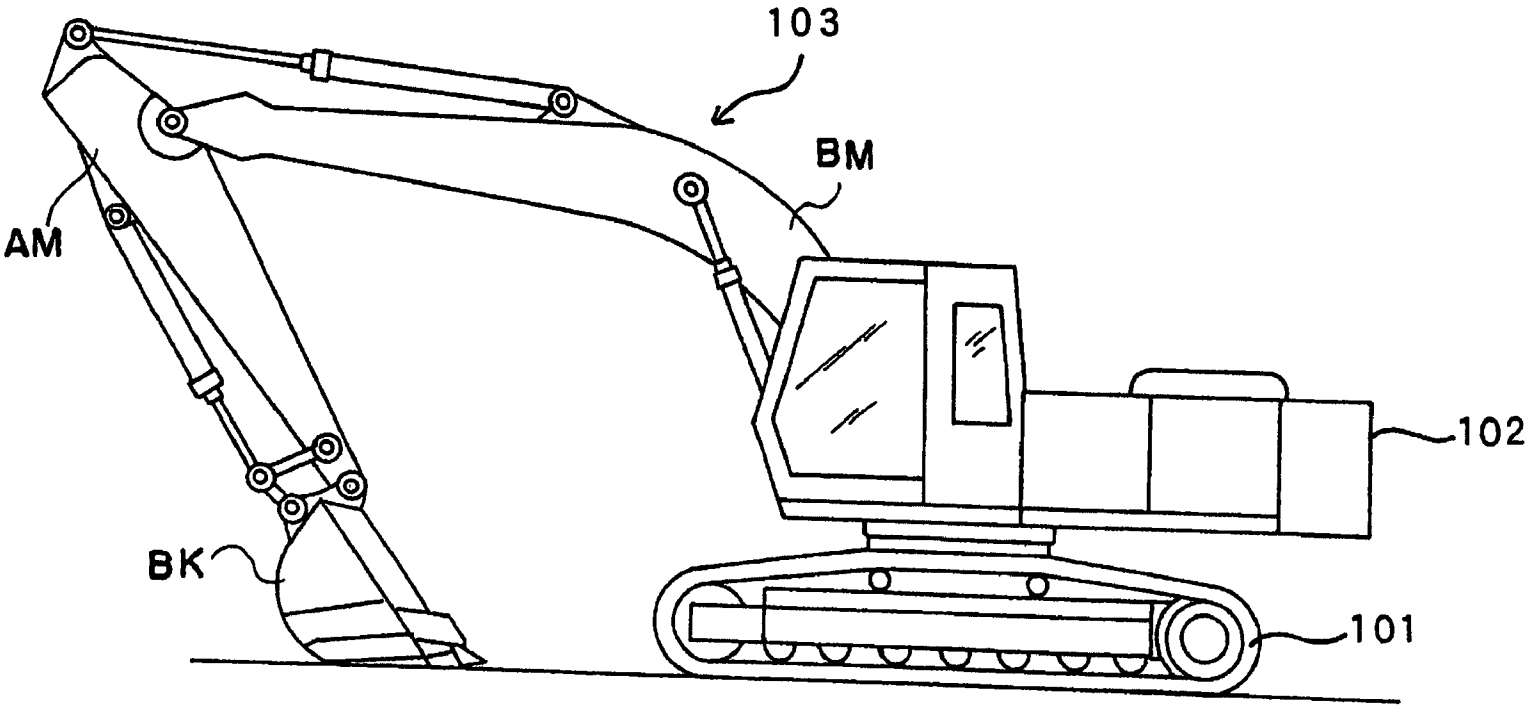

FIG. 1 shows the structure of the displacement control device achieved in the first embodiment of the present invention. This displacement control device may be installed in, for instance, the hydraulic excavator in FIG. 2. As shown in FIG. 2, the hydraulic excavator includes a undercarriage 101, a rotatable upperstructure 102 and a work device 103 constituted with a boom BM axially supported at the upperstructure so as to be allowed to move around freely, an arm AM and a bucket BK.

Pressure oil delivered from a variable-displacement hydraulic pump 1 in FIG. 1, which is driven by the engine (not shown), is supplied to a hydraulic actuator such as a cylinder used to drive the work device 103 via a control valve 11. The control valve 11, which is driven in response to an operation of an operation lever 12, controls the flow of the pressure oil to the hydraulic actuator in correspondence to the extent to which the operation lever 12 is operated. It is to be noted that an instruction with regard to a target pump displacement (displacement angle) θ0 for the hydraulic pump 1, too, is issued through the operation lever 12. The pressure oil from pumps 1 and 2 is guided to one of the oil chambers at a regulator 3, i.e., a rod chamber 3*a*, whereas the pressure oil from the pumps 1 and 2 is guided to another oil chamber (a bottom chamber 3*b*) at the regulator 3, via a hydraulic switching valve 6. The regulator 3 is driven in correspondence to the hydraulic forces applied to the rod chamber 3*a* and the bottom chamber 3*b*, and the displacement of the hydraulic pump 1 is thus controlled.

A pilot pressure (a secondary pressure Pa) from the pump 2 is applied to the hydraulic switching valve 6 via a proportional electromagnetic valve 4, and the hydraulic switching valve 6 is switched in correspondence to the secondary pressure Pa applied thereto. Namely, as the secondary pressure Pa at the proportional electromagnetic valve 4 increases, the hydraulic switching valve 6 is switched toward position A. This increases the hydraulic force applied to the bottom chamber 3*b*, which, in turn, increases the pump displacement. If, on the other hand, the secondary pressure Pa decreases, the hydraulic switching valve 6 is switched to position B. In this case, the hydraulic force applied to the bottom chamber 3*b* becomes smaller, thereby reducing the pump displacement. The secondary pressure Pa at the proportional electromagnetic valve 4 is detected with a pressure sensor 5.

Figure 3:
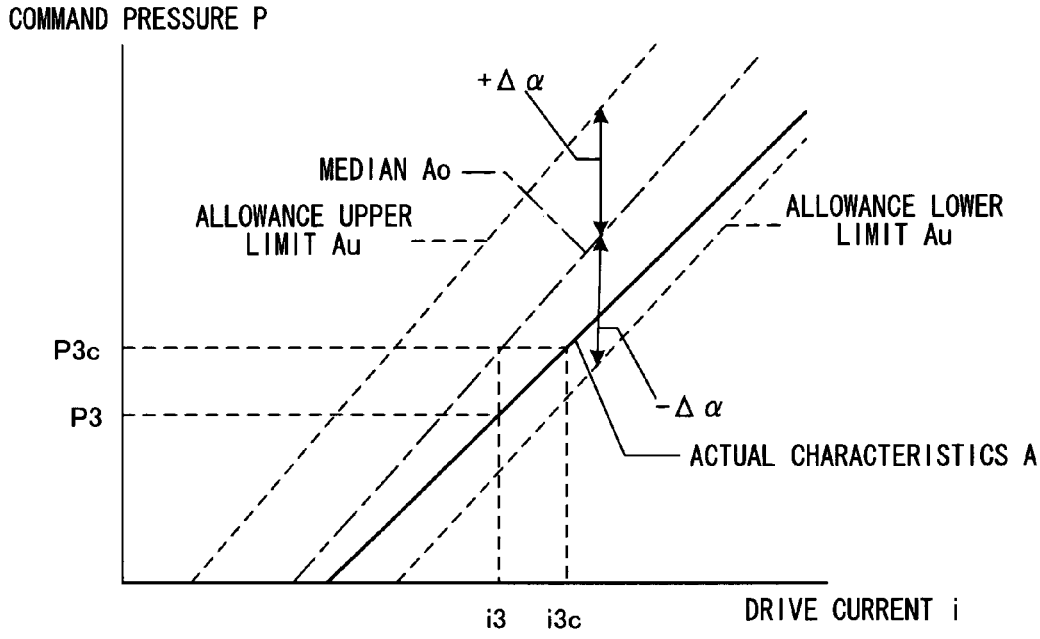
Figure 4:
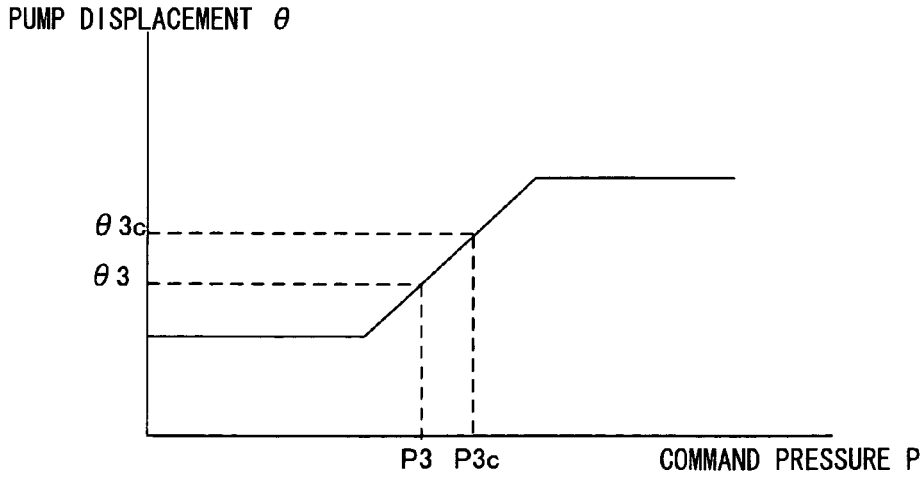

FIG. 3 presents an example of the input/output characteristics of the proportional electromagnetic valve 4, and FIG. 4 presents an example of the characteristics of the pump displacement (displacement angle) θ relative to a command pressure P (the secondary pressure Pa) at the proportional electromagnetic valve 4. Characteristics A0 in FIG. 3 represent reference characteristics, which indicate that the command pressure P increases as the drive current i to the proportional electromagnetic valve 4 increases. Such proportional electromagnetic valve characteristics are not consistent among individual proportional electromagnetic valves and they are bound to deviate from the reference characteristics A0 within a range of an allowable error ±Δα. Thus, the actual characteristics A are offset from the reference characteristics A0, as shown in the figure. This means that the actual command pressure generated by outputting a drive current i3 to the proportional electromagnetic valve 4 based upon the reference characteristics A0 in order to generate, for instance, a target command pressure P3*c*, is P3. In other words, the command pressure P3 actually generated does not match the target command pressure P3*c*. As a result, the actual pump displacement θ3 deviates from the target pump displacement θ3*c*, as shown in FIG. 4, and thus, the vehicle cannot be operated with good response to operations of the operation lever 12. Accordingly, the control signal output to the proportional electromagnetic valve 4 is corrected as detailed below in the embodiment.

A controller 10 is connected with the pressure sensor 5, a key switch 7, a mode switch 8 operated to switch to a learning mode or a standard mode as described later and a pressure sensor 9 that detects the control pressure (e.g., a positive control pressure Pn) corresponding to the extent to which the operation lever 12 is operated. The controller 10 executes the processing described below in response to signals input from these components and outputs a control signal to the proportional electromagnetic valve 4. Namely, the pump displacement is controlled in the embodiment based upon the signals provided by the pressure sensors 5 and 9 without utilizing a displacement angle sensor.

FIG. 5 presents a flowchart of an example of processing that may be executed by the controller 10 in the first embodiment. The processing in this flowchart starts as the key switch 7 is turned on and the power switch is turned on in response. First, a signal (a mode signal) from the mode switch 8 is read in step S1. In step S2, a decision is made as to whether or not the mode signal is on, i.e., whether or not the learning mode has been-selected. If an affirmative decision is made in step S2, processing corresponding to the learning mode (learning control) is executed, whereas if a negative decision is made, processing corresponding to the standard mode (standard control) is executed. The term "learning mode" in this context refers to a mode for determining through arithmetic operation a correction expression to be used in the pump displacement control, and after the correction expression is determined, the mode switch 8 is switched to execute the standard mode. It is to be noted that the operation may be switched to the standard mode after a predetermined length of time elapses following the start of the learning mode, instead of switching to the standard mode in response to a switching operation at the mode switch 8.

(1) Learning Control

After the learning control starts, the operation waits in standby in step S200 until the engine rotation rate becomes equal to a predetermined rotation rate so as to avoid executing the learning control in an unstable condition immediately after the engine startup. Next, in step S300, a control signal is output to the proportional electromagnetic valve 4 so as to achieve a minimum displacement of the pump. Through the processing in step S300, it is ensured that the learning control is executed in a constant initial state free of pump displacement fluctuations attributable to rattling of the swash plate at the hydraulic pump 1. Next, pump displacement learning arithmetic processing is executed in step S400.

Figure 9:
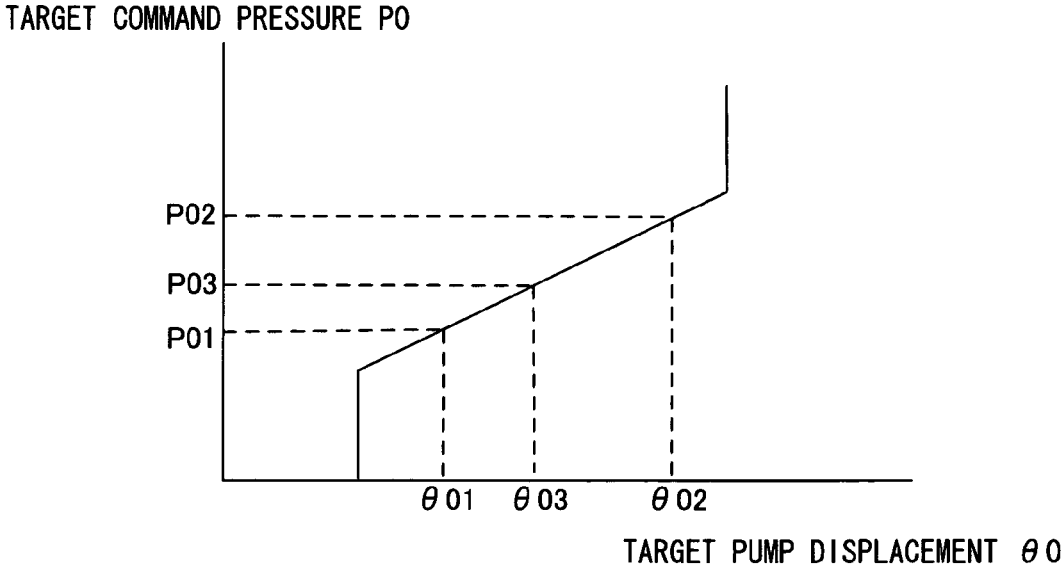

FIG. 6 presents a flowchart of the pump displacement learning arithmetic processing. In step S401 in FIG. 6, a learning control reference displacement θ01 is substituted for the target pump displacement θ0 and an initial value 0 is substituted for the value at an execution counter C3. It is to be noted that θ01 and θ02 in FIG. 9 are set in advance as reference displacements in the embodiment. The execution counter C3 counts the number of times the sequence of processing from step S402 through step S500 is executed. Next, in step S402, an initial value 0 is substituted for the value at a wait time counter C4. In step S403, a target command pressure P0 (=P01) corresponding to the target pump displacement θ0 (=θ01) is calculated based upon the predetermined target command pressure characteristics shown in FIG. 9. Next, in step S404, a target drive current i0 (=i01) corresponding to the target command pressure P0 (=P01) is calculated based upon the target drive current characteristics shown in FIG. 10.

In step S405, a drive current i corresponding to the target drive current i0 is output to the proportional electromagnetic valve 4. Then, i is added to the value at the wait time counter C4 in step S406, and a decision is made in step S407 as to whether or not the value at the wait time counter C4 has become equal to a predetermined value setting R4. The value setting R4 represents the length of time (e.g., 2 sec) required for the pump displacement to become equal to the target pump displacement θ0. If a negative decision is made in step S407, the operation returns to step S405 to repeatedly execute the same processing until C4 becomes equal to or greater than R4.

Upon making an affirmative decision in step S407, the operation proceeds to step S408 to substitute an initial value 0 for the value at a read counter C5. Next, the secondary pressure Pa at the proportional electromagnetic valve 4 detected with the pressure sensor 5 is read and stored into memory at the controller 10 in step S409. In step S410, 1 is added to the value at the read counter C5 and then a decision is made in step S411 as to whether or not the value at the read counter C5 has become equal to a predetermined specific value R5 (e.g., 10 reads). If a negative decision is made in step S411, the operation returns to step S409 and the same processing is repeatedly executed until C5 becomes equal to or greater than R5.

Upon making an affirmative decision in step S411, the operation proceeds to step S412 to calculate the average (average secondary pressure) Paa of the secondary pressures Pa by dividing the sum of the secondary pressures Pa having been stored in step S409 by R5. Then, a pressure deviation or difference ΔP0 (=P0−Paa) is determined by subtracting the average secondary pressure Paa from the target command pressure P0 (=P01) having been calculated in step S403 and the deviation ΔP0 thus determined is stored in the controller 9 in step S413. Next, in step S500, learning arithmetic value check processing is executed to ascertain whether or not an optimal deviation ΔP0 has been calculated.

Figure 7:
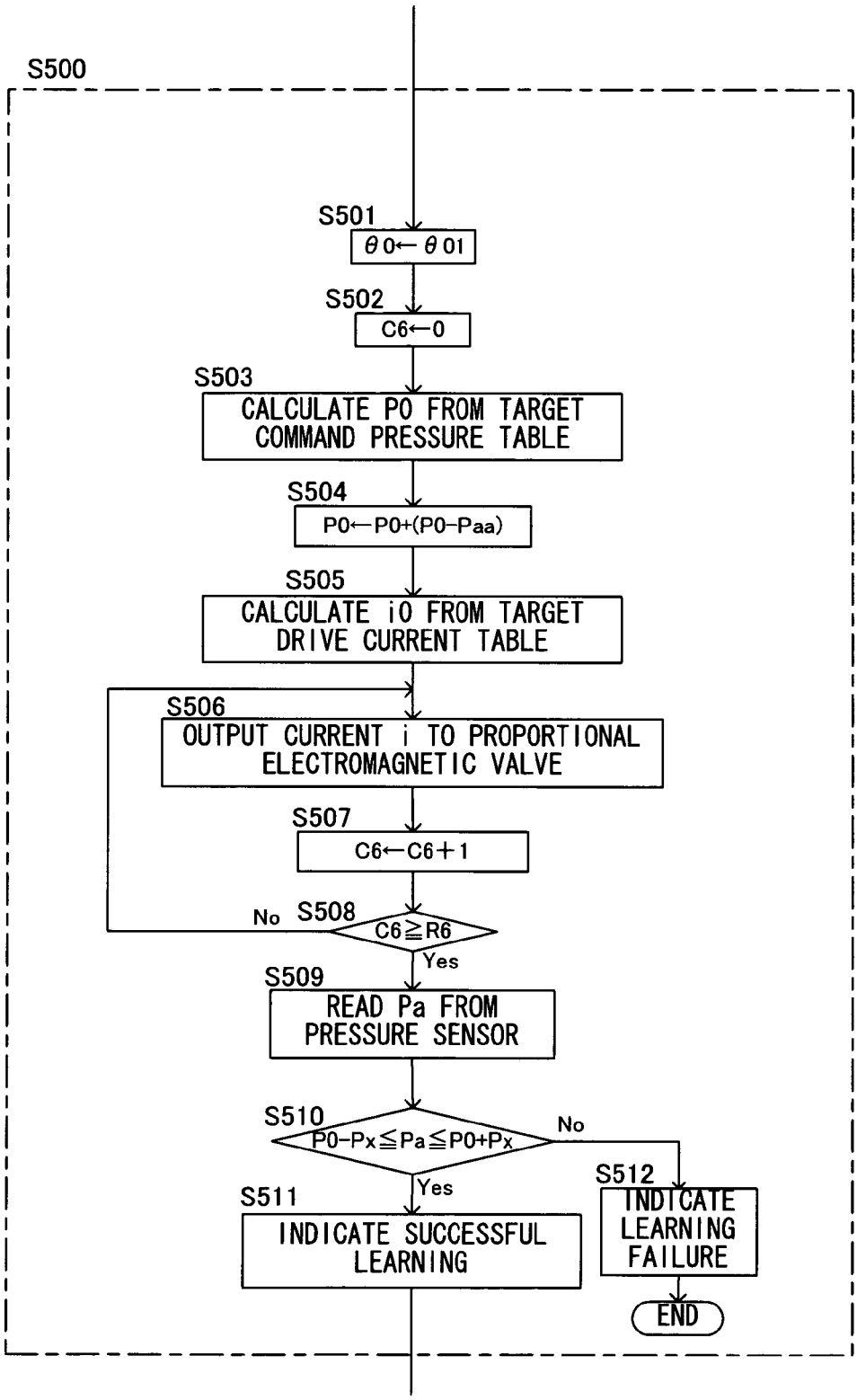

FIG. 7 presents a flowchart of the learning arithmetic value check processing. In step S501 in FIG. 7, the reference displacement θ01 is substituted for the target pump displacement θ0. Next, an initial value 0 is substituted for the value at a wait time counter C6 in step S502. In step S503, the target command pressure P0 (=P01) corresponding to the target pump displacement 90 (=θ01) is calculated based upon the target command pressure characteristics in FIG. 9. Next, the deviation ΔP0 (=P0−Paa) having been calculated in step S413 is added to the target command pressure P0, and the resulting sum is substituted for the target command pressure P0 in step S504. In step S505, the target drive current i0 corresponding to the target command pressure P0 is calculated based upon the target drive current characteristics in FIG. 10, and a drive current i corresponding to the target drive current i0 is output to the proportional electromagnetic valve 4 in step S506. Then, 1 is added to the value at the wait time counter C6 in FIG. S507, and a decision is made in step S508 as to whether or not the value at the wait time counter C6 has become equal to a predetermined value setting R6 (e.g., 2 sec).

Upon making an affirmative decision in step S508, the operation proceeds to step S509 to read the secondary pressure Pa detected with the pressure sensor 5. In step S510, a decision is made as to whether or not the difference between the secondary pressure Pa and the target command pressure P0 having been calculated in step S504 is equal to or less than a predetermined allowable value Px, i.e., whether or not P0−Px≦Pa≦P0+Px is true. The operation proceeds to step S511 if an affirmative decision is made in step S510. In step S511, a specific control signal is output to a display device (e.g., an LED) (not shown) so as to prompt the display device to indicate that the learning processing has been successful. If, on the other hand, a negative decision is made in step S510, the operation proceeds to step S512 to output a specific control signal to the display device, prompting the display device to indicate that the learning processing has not been successful. For instance, the LED may flash as the learning processing starts in step S500, and the LED may go off once the learning processing is completed successfully, whereas the LED may be set in a steady on state if the learning processing has not been successful. Once the learning processing is completed successfully, the operation proceeds to step S414 in FIG. 6, whereas the processing ends if the learning processing has not been successful. It is to be noted that if the learning processing has been a failure, an operator may issue a command for re-execution of the learning control, or he may conduct an inspection to ensure that no failure has occurred in the pressure sensor 5, the pressure sensor 9, the proportional electromagnetic valve 6 or the like.

In step S414, 1 is added to the value at the execution counter C3. Then, a decision is made in step S415 as to whether or not the value at C3 has become equal to a predetermined specific value R3. R3 assumes a value representing the number of reference displacement settings. Since two reference displacements, i.e., θ01 and θ02, are set in this embodiment, R3=2. If a negative decision is made in step S415, the operation proceeds to step S416 to substitute the other reference displacement θ02 for the target pump displacement θ0. Subsequently, the processing in steps S402 through S414 is executed as described above based upon the other reference displacement processing θ02. An affirmative decision is made in step S415 after the deviations ΔP01 and ΔP02 are calculated in correspondence to the reference displacements θ01 and θ02, thereby ending the pump displacement learning arithmetic processing. Upon ending the pump displacement learning arithmetic processing, pump displacement correction expression calculation processing in step S600 (see FIG. 5) is executed.

Figure 8:
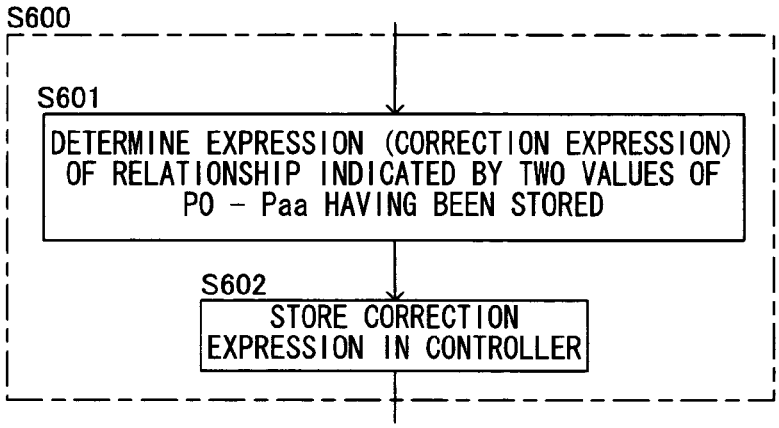
Figure 11:
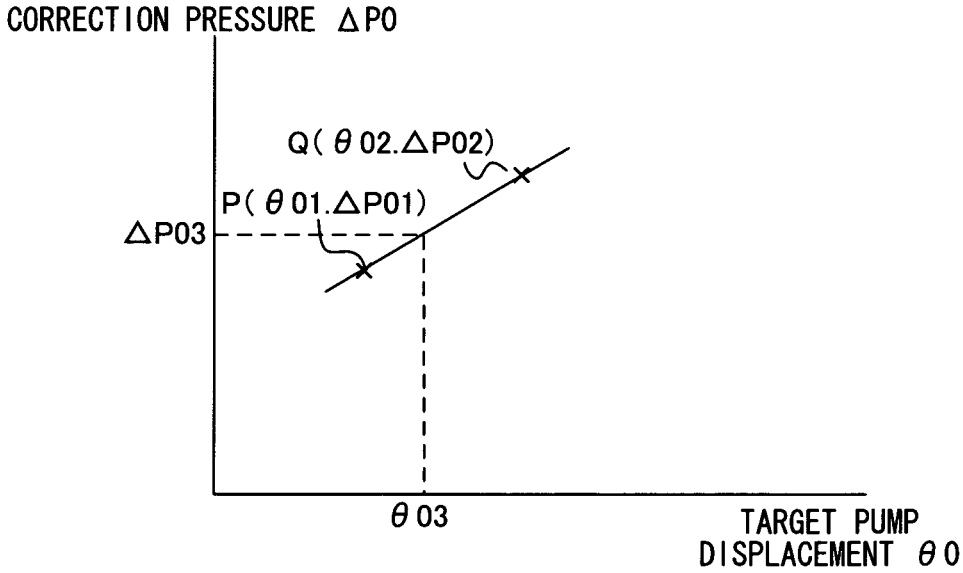
Figure 12:
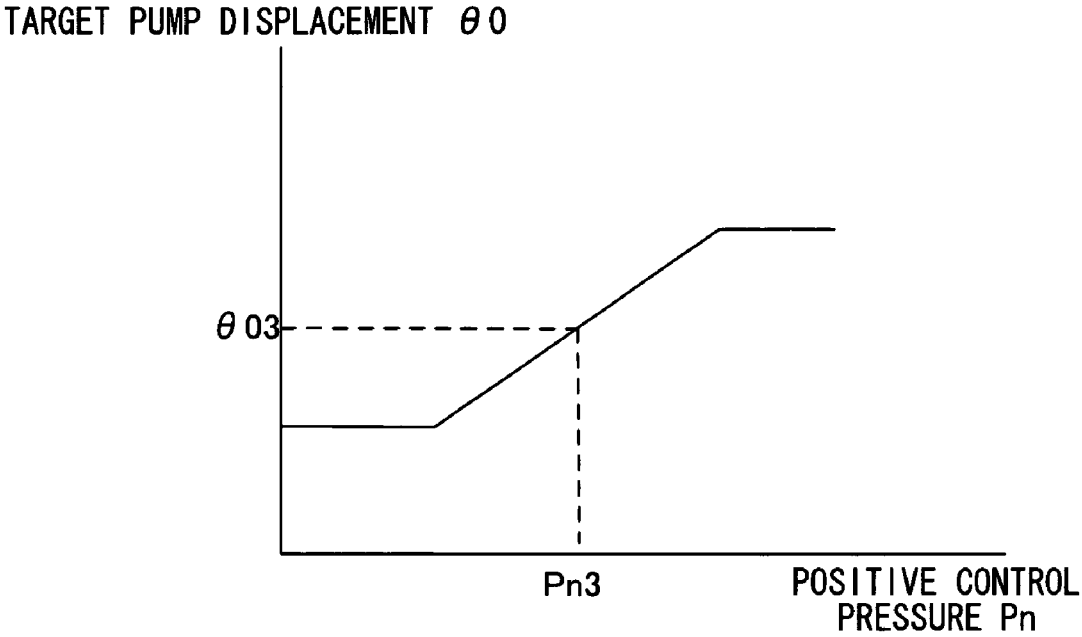

FIG. 8 presents a flowchart of the pump displacement correction expression calculation processing. In step S601 in FIG. 8, a correction expression for the target command pressure P0 is determined based upon the pressure deviations ΔP01 (=P01−Paa) and ΔP02 (=P02−Paa) having been calculated respectively in correspondence to the reference displacements θ01 and θ02. The correction expression determined in this step is a linear expression represented by a straight line passing through a point P (θ01, ΔP1) and a point Q (θ02, ΔP2), as shown in FIG. 11, which is expressed as in (1) below.

$$\Delta P0=((\Delta P02-\Delta P01)/(\theta 02-\theta 01))\theta 0+C \quad (1)$$

Next, the correction expression (1) is stored into the controller 10 in step S602. In this step, instead of directly storing the linear expression, the proportional constant (ΔP02−ΔP01)/(θ02−θ01) and the constant C may be individually stored.

Through the learning control described above, the target command pressures P01 and P02 corresponding to the predetermined reference displacements θ01 and θ02 are individually determined (step S403). The target drive currents i01 and i02 corresponding to these target command pressures P01 or P02 are each output to the proportional electromagnetic valve 4 (step S405), the corresponding secondary pressures Paa are each detected (step S409) and the corresponding difference ΔP01 or ΔP02 between the target command pressure P01 or P02 and the secondary pressure Paa is determined (step S413). Then, the differences (the absolute values representing the differences) between the corrected target command pressures P0, calculated by adding the deviations ΔP01 and ΔP02 respectively to the target command pressures P01 and P02, and the secondary pressures Paa generated by outputting the target drive currents i corresponding to the respective target command pressures P0 are checked to determine whether or not they are equal to or less than the allowable value Px (step S510). If they are determined to be equal to or less than the allowable value Px, it is judged that the learning control has been executed correctly and correction expression (1) is obtained accordingly (step S601). The standard control is executed as detailed below by using correction expression (1) obtained as described above.

(2) Standard Control

If it is decided in step S2 in FIG. 5 that the mode signal is in an off state, the standard (or normal) control starts. First, in step S101, the positive control pressure Pn detected with the pressure sensor 9 is read. It is to be noted that the following explanation is given on an assumption that the detected positive control pressure value is Pn3. Then, in step S102, a target pump displacement θ0 (=θ03) corresponding to the positive control pressure Pn (=Pn3) is determined based upon the predetermined target pump displacement characteristics shown in FIG. 12. In step S103, a target command pressure P0 (=P03) corresponding to the target pump displacement 90 (=θ03) is determined based upon the characteristics in FIG. 9 mentioned earlier. In step S104, a correction pressure ΔP0 (ΔP03 in FIG. 11) corresponding to the target pump displacement 90 (=θ03) is calculated by using correction expression (1) having been stored in step S602. Next, in step S105, the value obtained by adding the correction pressure ΔP0 (=ΔP03) to the target command pressure P0 (=P03) is substituted for the target command pressure P0, and in step S106, a target drive current i0 (=i03*c*) corresponding to the corrected target command pressure P0 (=P03*c*) is calculated based upon the characteristics in FIG. 10 mentioned earlier. Then, the target drive current i0 (=i03*c*) is output to the proportional electromagnetic valve 4 in step S107.

When the positive control pressure is Pn3, the target drive current i03*c* output to the proportional electromagnetic valve 4 sets the secondary pressure at the proportional electromagnetic valve 4 to P3*c*, as shown in FIG. 3. This secondary pressure is equal to the secondary pressure corresponding to the drive current i3 calculated based upon the reference characteristics A0. Thus, regardless of any inconsistency that may exist with regard to the characteristics of individual proportional electromagnetic valves 4, it is possible to generate the secondary pressure P3*c* corresponding to the positive control pressure Pn3. As a result, the pump displacement can be controlled so as to achieve the target pump displacement θ3*c*, as shown in FIG. 4.

The following advantages are achieved in the first embodiment described above.

(1) Under the learning control, correction expression (1) to be used for pump displacement control is determined by using the values detected with the pressure sensor 5, and the proportional electromagnetic valve 4 is controlled under the standard control by correcting the target drive current i based upon correction expression (1). Regardless of any inconsistency that may exist among the characteristics of individual proportional electromagnetic valves 4, the pump displacement can always be controlled accurately. Thus, the fine operability and operational feel of the hydraulic work machine are improved, which, in turn, helps improve the work efficiency.

(2) Correction expression (1) is determined in correspondence to the deviations ΔP0 each representing the difference between a target command pressure P0 and the secondary pressure Pa (the average value Paa) detected at the proportional electromagnetic valve 4 by the pressure sensor 5 under the learning control. Since correction expression (1) can be determined without having to use a displacement angle sensor, the displacement control device can be provided at a lower cost.

(3) Since the pressure sensor 5 has temperature characteristics superior to those of a displacement angle sensor, the pump displacement can be corrected with great accuracy even when the vehicle is engaged in operation under high temperature conditions.

(4) Under the standard control, the pump displacement is controlled in an open loop instead of by executing feedback control, and thus, no response delay occurs in the pump displacement control.

Second Embodiment

Figure 13:
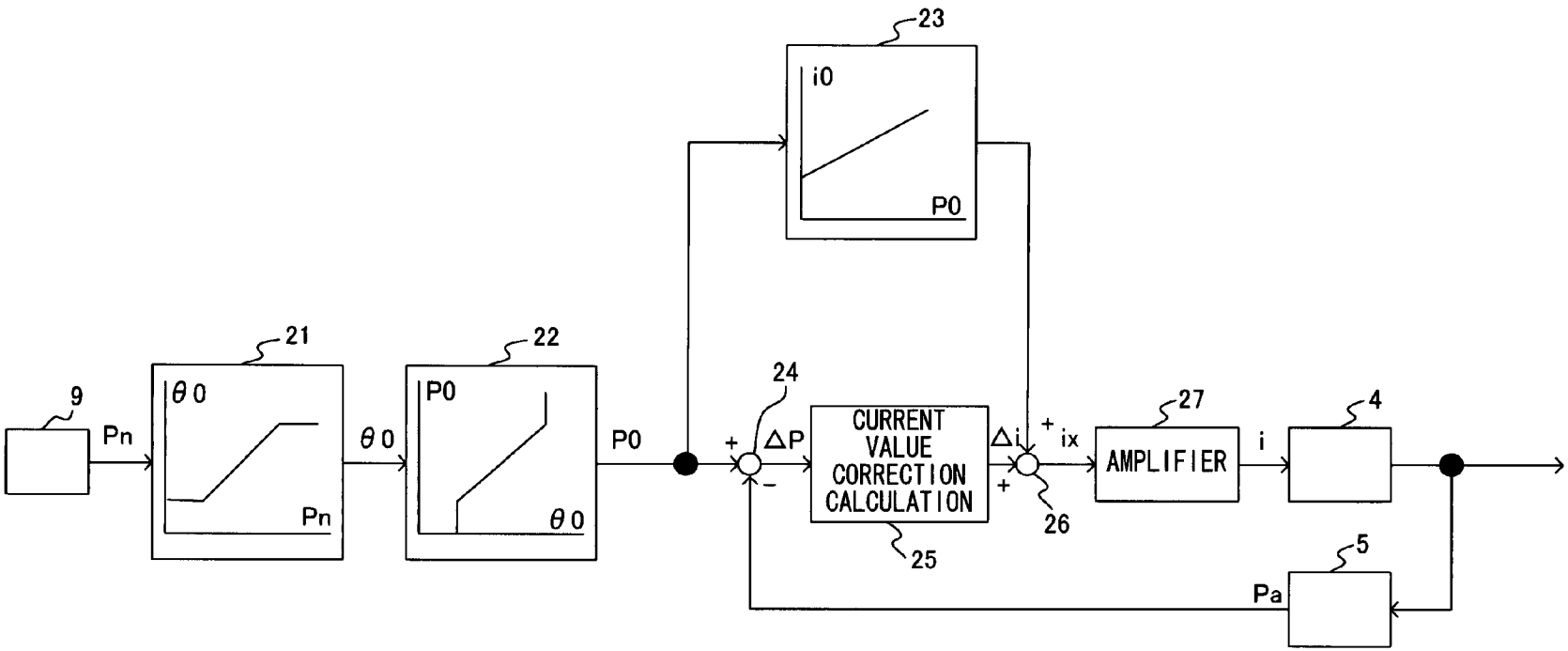

In reference to FIG. 13, the second embodiment of the displacement control device according to the present invention is explained.

The second embodiment differs from the first embodiment in the processing executed in the controller 10. Namely, the pump displacement θ is controlled through feedback control in the second embodiment.

FIG. 13 is a block diagram detailing the arithmetic operation executed in the controller 10 in the second embodiment. The positive control pressure Pn detected with the pressure sensor 9 is read into a target pump displacement calculation circuit 21. The target pump displacement calculation circuit 21 calculates a target pump displacement θ0 corresponding to the positive control pressure Pn based upon preset characteristics similar to those shown in FIG. 12. The target pump displacement θ0 thus calculated is taken into a target command pressure calculation circuit 22 that calculates a target command pressure P0 corresponding to the target pump displacement θ0 based upon preset characteristics similar to those shown in FIG. 9. The target command pressure P0 is then read into a target drive current calculation circuit 23 and a subtractor circuit 24.

Figure 10:
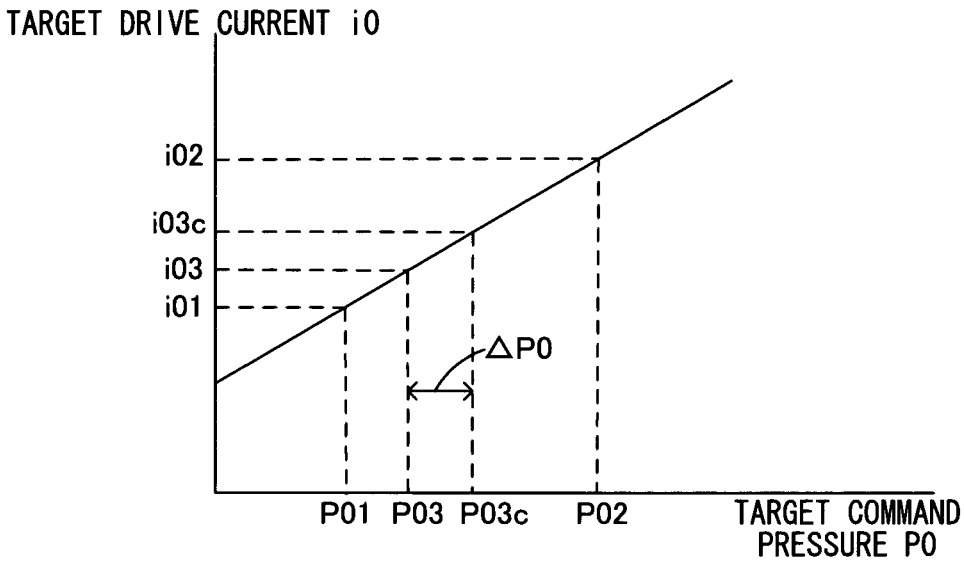

The target drive current calculation circuit 23 calculates a target drive current i0 corresponding to the target command pressure P0 based upon preset characteristics similar to those shown in FIG. 10. The subtractor circuit 24 subtracts the secondary pressure Pa detected by the pressure sensor 5 from the target command pressure P0, thereby determining a pressure deviation ΔP (=P0−Pa). The deviation ΔP is taken into a current value correction calculation circuit 25 which then calculates a correction current Δi corresponding to the deviation ΔP based upon preset characteristics similar to those shown in FIG. 10. The target drive current i0 and the correction current Δi are taken into an adder circuit 26 that calculates a corrected target drive current ix by adding the correction current Δi to the target drive current i0. An amplifier 27 amplifies the target drive current ix and outputs the amplified target drive current to the proportional electromagnetic valve 4.

If the secondary pressure Pa detected with the pressure sensor 5 is greater than the target command pressure P0, the deviation ΔP is smaller than 0 and the target drive current ix is smaller than the target drive current i0 in the second embodiment. Thus, the feedback control is executed for the proportional electromagnetic valve 4 so that the secondary pressure Pa matches the target command pressure P0. If, on the other hand, the secondary pressure Pa detected with the pressure sensor 5 is smaller than the target command pressure P0, the deviation ΔP is greater than 0 and the target drive current ix is greater than the target drive current i0. Accordingly, feedback control is executed for the proportional electromagnetic valve 4 so as to match the secondary pressure Pa with the target command pressure P0.

The second embodiment, in which feedback control is executed for the proportional electromagnetic valve 4 so as to set the secondary pressure Pa equal to the target command pressure P0, the pump displacement can be controlled with a high level of accuracy even when inconsistency exists with regard to the characteristics of individual proportional electromagnetic valves 4. In addition, since the displacement control is achieved without having to use a displacement angle sensor, the displacement control device can be provided at a lower cost. Since feedback control does not require any learning control to be executed prior to the standard control, the operational process is expedited.

Third Embodiment

The third embodiment of the displacement control device according to the present invention is now explained in reference to FIGS. 14 through 19.

Under normal circumstances, the proportional electromagnetic valve 4 will assume a structure that causes it to vibrate constantly (dither vibration) in order to prevent the spool from becoming seized. For this reason, the value of the secondary pressure Pa detected by the pressure sensor 5 fluctuates and the fluctuation is a factor that lowers the accuracy of the pump displacement correction. This aspect has been addressed in the third embodiment. It is to be noted that the third embodiment differs from the first embodiment in the processing executed in the controller 10, and the following explanation focuses on the difference from the first embodiment.

Figure 14:
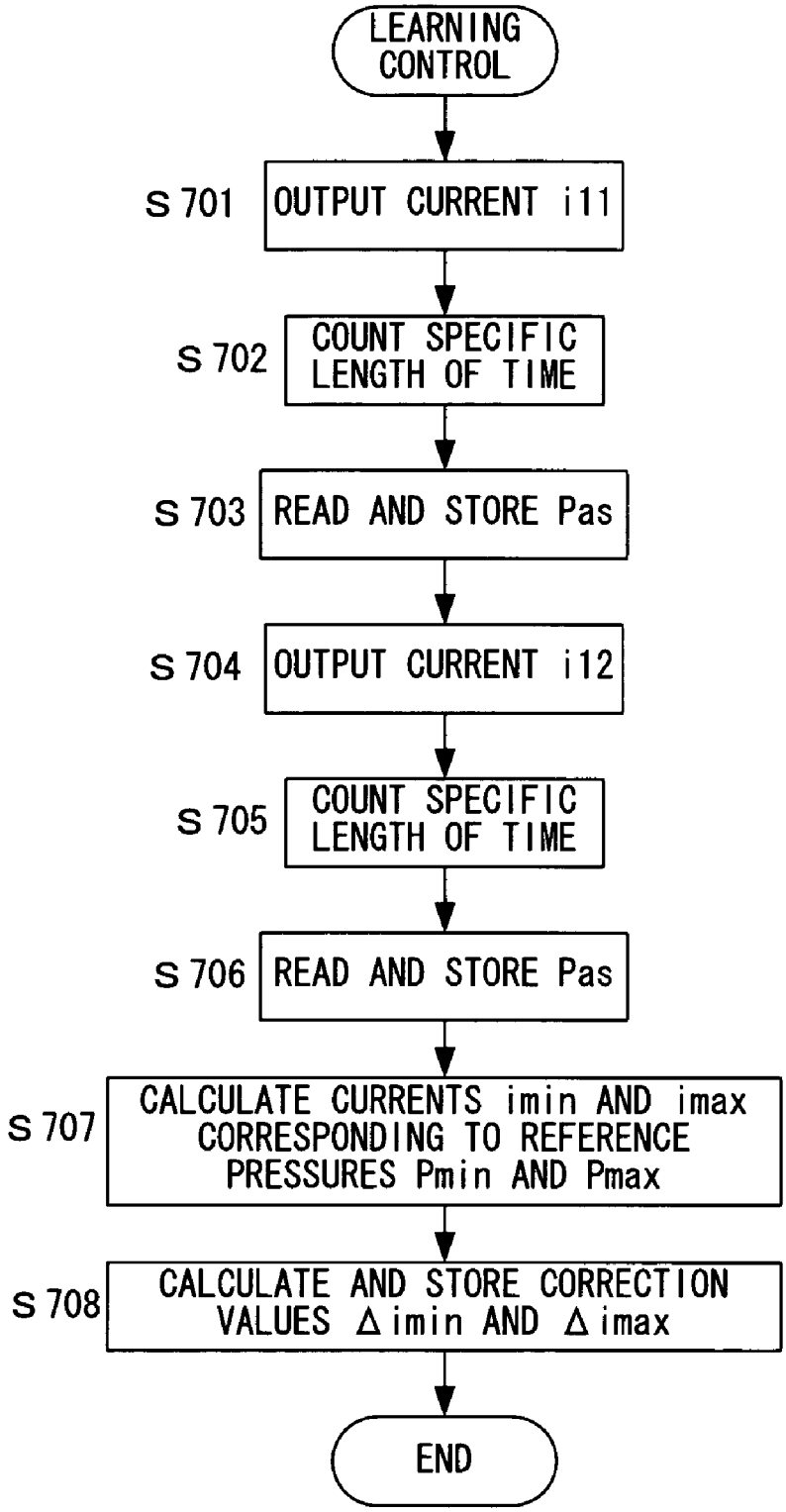
Figure 15:
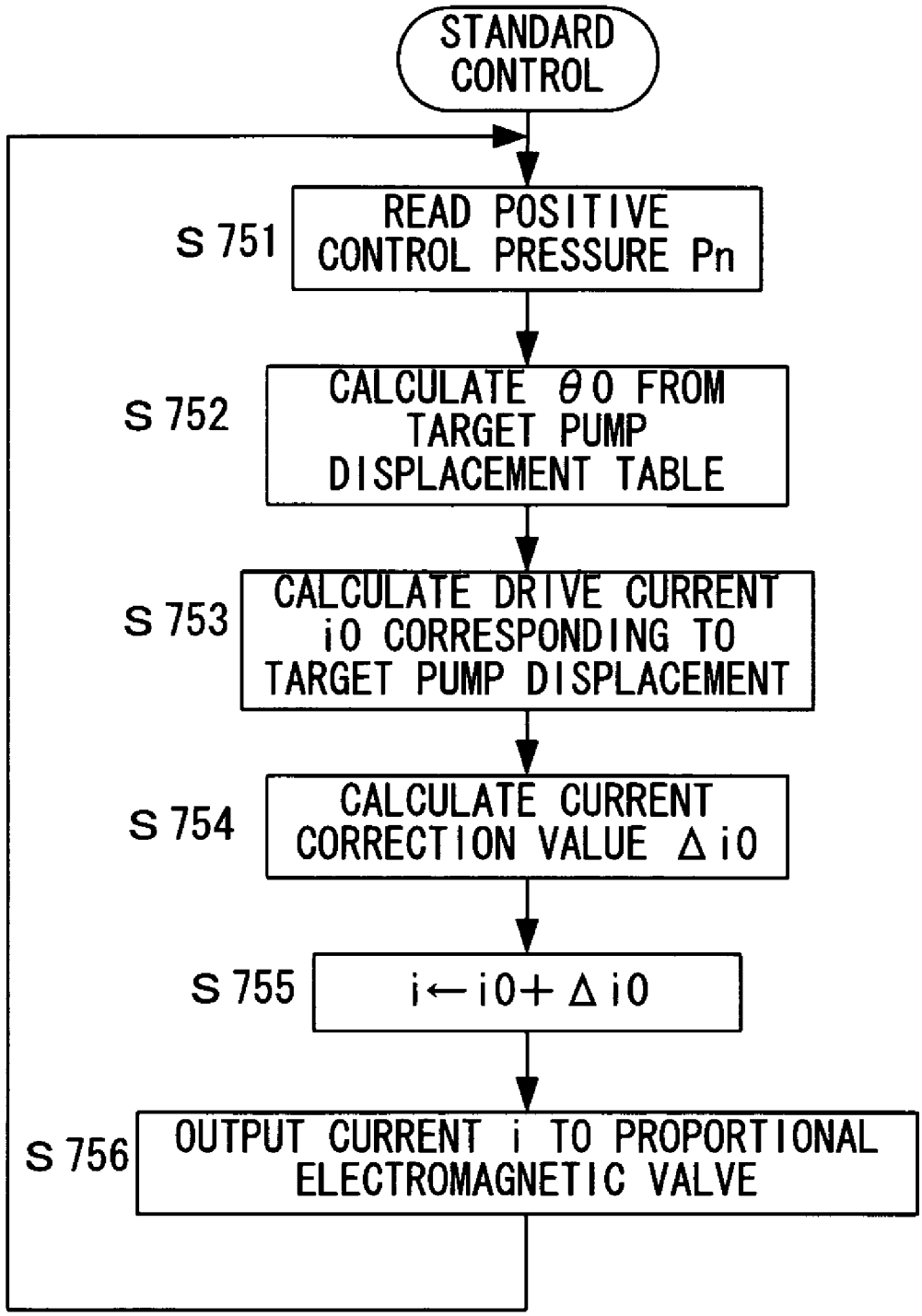
Figure 17:
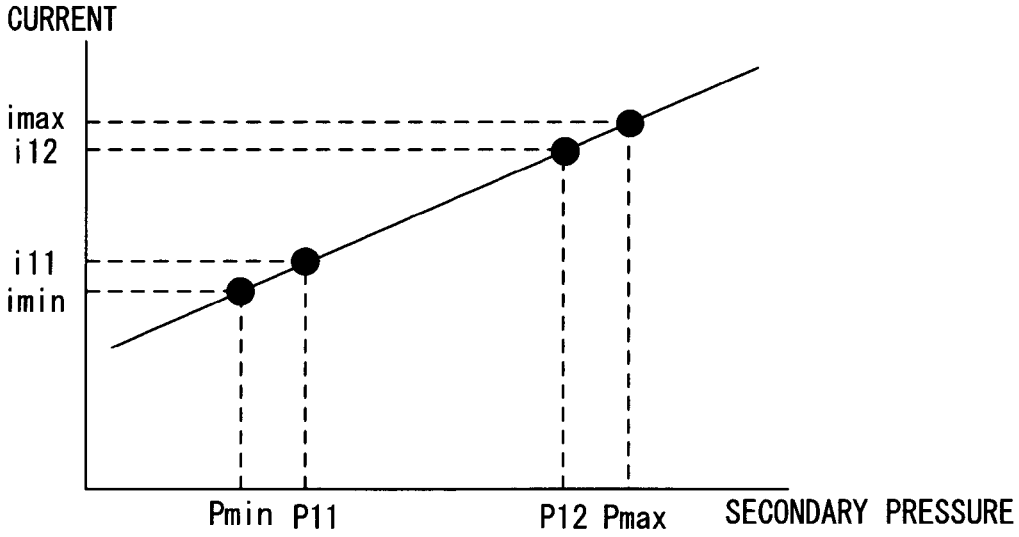

In the controller 10, a secondary pressure design value (reference control pressure Pmin) of the proportional electromagnetic valve 4 corresponding to the minimum pump displacement θmin, the corresponding drive current (reference control signal) iAmin for the proportional electromagnetic valve 4, a secondary pressure value (reference control pressure Pmax) corresponding to the maximum pump displacement θmax, and the corresponding drive current (reference control signal) iAmax are stored in advance (see FIGS. 17 and 18). FIG. 14 presents a flowchart of an example of learning control that may be executed in the controller 10 of the displacement control device achieved in the third embodiment, and FIG. 15 presents a flowchart of an example of standard control.

As in the first embodiment, the learning control starts as the mode switch 8 is turned on in the third embodiment. Namely, in step S701, a drive current i11 (e.g., iAmin) corresponding to the minimum pump displacement θmin or a displacement θ close to the minimum pump displacement is calculated based upon predetermined design characteristics (f0 in FIG. 18) of the proportional electromagnetic valve 4 and this drive current i11 is output to the proportional electromagnetic valve 4. Then, in step S702, a predetermined length of time (e.g., 5 sec) is allowed to elapse until the secondary pressure data become stable and when the predetermined length of time has elapsed, the secondary pressure Pas obtained through the following sampling processing is read.

Figure 16:
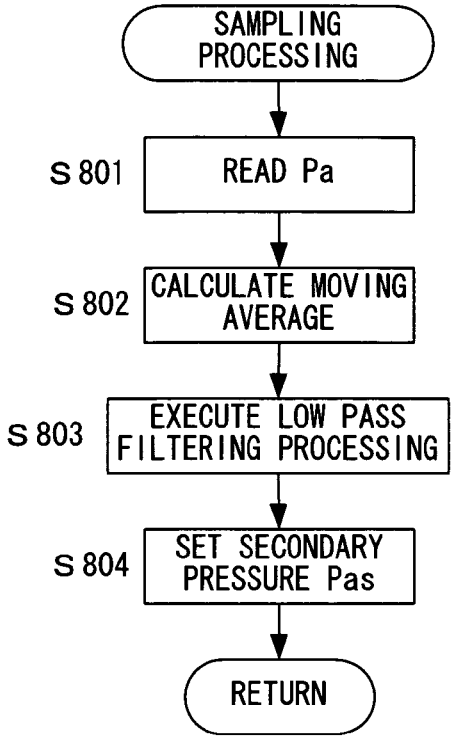

FIG. 16 presents a flowchart of the secondary pressure sampling processing. The processing in this flowchart is constantly executed after the power switch is turned on. First, the secondary pressure Pa at the proportional electromagnetic valve 4 detected by the pressure sensor 5 is read in step S801. Next, a moving average of the secondary pressure values Pa is calculated in step S802. The moving average value can be calculated by dividing the sum of the values indicated by a predetermined number (e.g., four) of sets of secondary pressure data having been most recently read, by the predetermined number. For instance, assuming that secondary pressures Pa1, Pa2, Pa3 and Pa4 have been sampled sequentially, the moving average can be calculated as (Pa1+Pa2+Pa3+Pa4)/4, and as data Pa5 are sampled at the next instance, the moving average value is switched to (Pa2+Pa3+Pa4+Pa5)/4.

In step S803, a low pass filter is applied to the moving average value (low pass filter processing), and the filtered value is set in step S804 as a secondary pressure Pas having undergone the sampling processing. Thus, any component of vibration is eliminated from the data having been detected by the pressure sensor 5. The secondary pressure Pas thus obtained is read and is stored into memory as a measured secondary pressure P11 in step S703 in FIG. 14.

Then, in step S704, a drive current i12 (e.g., iAmax) corresponding to the maximum pump displacement θmax or a displacement θ close to the minimum pump displacement, which is determined based upon the predetermined design characteristics (f0 in FIG. 18) of the proportional electromagnetic valve 4, is output to the proportional electromagnetic valve 4. Then, in step S705, a predetermined length of time (e.g., 5 sec) is allowed to elapse until the secondary pressure data become stable. When the predetermined length of time has elapsed, the secondary pressure Pas obtained through the sampling processing described earlier is read and stored into memory as a measured secondary pressure P12. Consequently, the relationship (measured values) of the secondary pressure and the control signal (current), such as that shown in FIG. 17, is determined.

In step S707, drive currents imin and imax corresponding to predetermined reference control pressures Pmin and Pmax are calculated based upon the relationship shown in FIG. 17. The drive currents are calculated as expressed in (II) below.

$$i\min = i11 - (P11 - P\min) \times (i12 - i11)/(P12 - P11)$$

$$i\max = i12 + (P\max - P12) \times (i12 - i11)/(P12 - P11) \quad \text{(II)}$$

The values of imin and imax thus calculated represent the drive currents corresponding to the minimum displacement θmin and the maximum displacement θmax at the particular proportional electromagnetic valve 4. In other words, the actual pump displacements of θmin and θmax are respectively achieved by outputting the currents imin and imax to the proportional electromagnetic valve 4.

Figure 19:
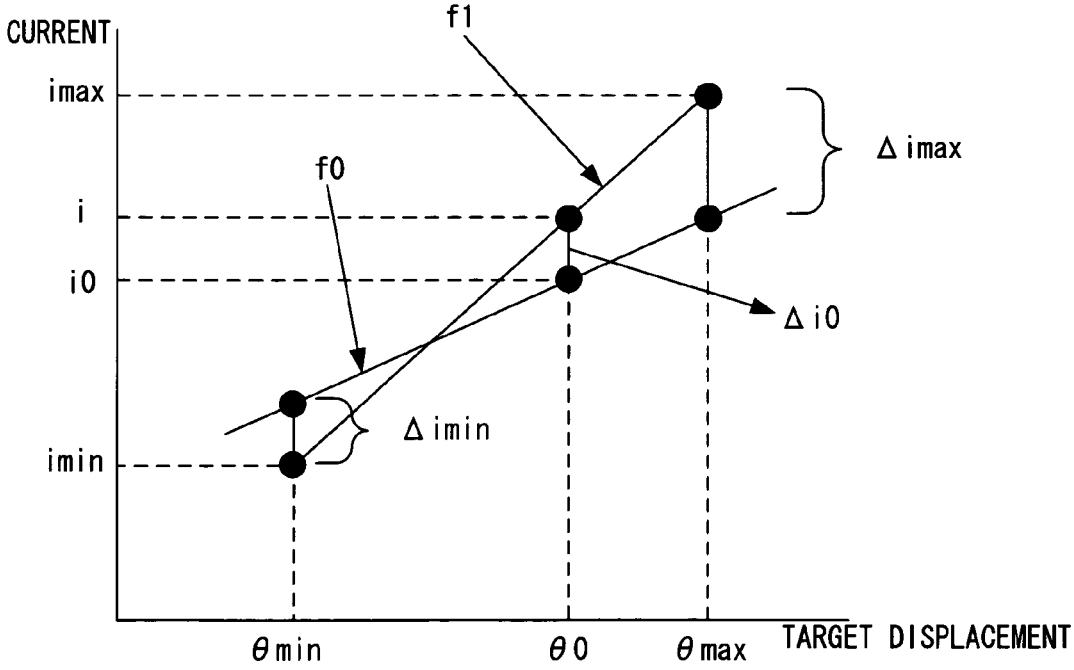

Next, in step S708, current correction values Δimin and Δimax in FIG. 18 are respectively calculated by subtracting predetermined drive currents iAmin and iAmax from imin and imax and the current correction values thus calculated are stored into memory. Thus, correction characteristics f1 of the proportional electromagnetic valve 4, such as those shown in FIG. 19, are determined. The learning control thus ends. It is to be noted that at the end of the learning control, a lamp or the like at the operator's seat may be turned on to inform the operator of the completion of the learning control. The deviation (correction value Δia) between the reference characteristics f0 and the correction characteristics f1 corresponding to the target pump displacement θ0 can be calculated as expressed in (III) below.

$$\Delta ia = \Delta i\min + (\theta a - \theta\min) \times (\Delta i\max - \Delta i\min)/(\theta\max - \theta\min) \quad \text{(III)}$$

As the mode switch 8 is turned off upon completion of the learning control, the standard control in FIG. 15 starts. First, the positive control pressure Pn (e.g., Pn3 in FIG. 12) detected by the pressure sensor 9 is read in step S751. Then, in step S752, a target pump displacement θ0 (=θ03) corresponding to the positive control pressure Pn (=Pn3) is determined based upon the target pump displacement characteristics shown in FIG. 12. In step S753, a drive current i0 corresponding to the target pump displacement θ0 is calculated based upon the reference characteristics f0 (see FIG. 19) of the proportional electromagnetic valve 4.

In step S754, a current correction value Δi0 corresponding to the target pump displacement θ0 is calculated, as expressed in (III) above, by using the current correction values Δimin and Δimax having been obtained through the learning control. Next, in step S755, a target drive current i is calculated by adding the current correction value Δi0 to the drive current i0 and, in step S756, the target drive current i thus calculated is output to the proportional electromagnetic valve 4. The processing described above is repeatedly executed under the standard control.

As described above, the moving average of the values Pa detected by the pressure sensor 5 is determined and a low pass filter is applied to the moving average, thereby removing the vibration component in the detected values Pa (sampling processing). The current correction values Δimin and Δimax to be used for reference when controlling the proportional electromagnetic valve 4 are calculated in reference to the secondary pressures Pas having undergone the sampling processing (learning control) and the current correction value Δi0 corresponding to the target pump displacement θ0 is calculated (standard control). Namely, instead of directly reading the values Pa detected by the pressure sensor 5 under the learning control, the values Pas having undergone the sampling processing are read. As a result, even if there is a fluctuation with regard to the detected pressure values Pa due to the dither vibration of the proportional electromagnetic valve 4, stable secondary pressure Pas is used in the learning control and thus, the current correction values Δimin and Δimax to be used for reference in controlling the proportional electromagnetic valve 4 can be obtained with a high degree of accuracy, thereby enabling accurate control of the pump displacement to achieve the target pump displacement θ0.

Fourth Embodiment

Figure 20:
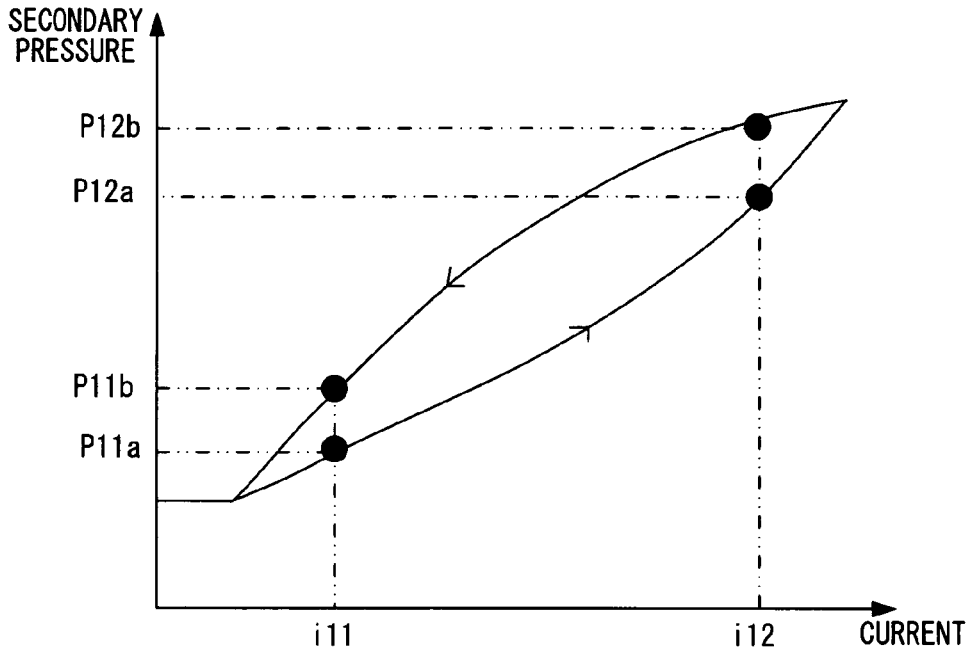
Figure 21:
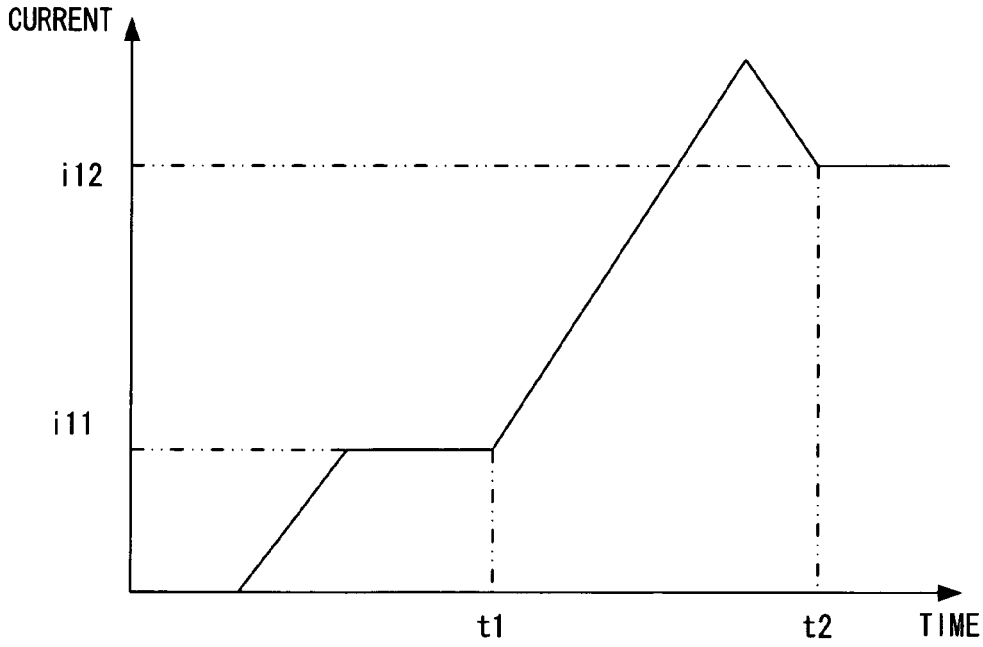

The fourth embodiment of the displacement control device according to the present invention is explained in reference to FIGS. 20 and 21.

While the third embodiment described above is achieved by taking into consideration the dither vibration of the proportional electromagnetic valve 4, the fourth embodiment is achieved by also taking into consideration the hysteresis of the proportional electromagnetic valve 4. Namely, a hysteresis such as that shown in FIG. 20 manifests in the current pressure characteristics of the proportional electromagnetic valve 4, and thus, the secondary pressures detected while increasing the current, e.g., a secondary pressure P11*a* corresponding to the minimum pump displacement θmin and a secondary pressure P12*a* corresponding to the maximum pump displacement θmax, are smaller than the secondary pressures (P11*b*, P12*b*) detected while decreasing the current. Accordingly, the values of the actually measured secondary pressures to be used for reference are affected by how the drive currents i11 and i12 are output to the proportional electromagnetic valve 4 during the learning control, i.e., how the currents are output in steps S701 and S704 in FIG. 14, which, in turn, affects the current correction values Δimin and Δimax.

Since P11*a*<P11*b* and P12*a*<P12*b*, the smallest secondary pressure P11*a* has optimal correspondence to the minimum pump displacement θmin and the largest secondary pressure P12*b* has optimal correspondence to the maximum pump displacement θmax. With this point taken into consideration, the currents i11 and i12 are output to the proportional electromagnetic valve 4 respectively in step S701 and step S704 in FIG. 14 in the fourth embodiment as described below.

Namely, after starting the learning control, the drive current is increased to i11 and is output as shown in FIG. 21 in step S701. As a result, the pressure P11 measured (step S703) after a predetermined length of time elapses (at a time point t1) is equal to the smallest secondary pressure P11*a* corresponding to the minimum pump displacement θmin. In step S704, on the other hand, the drive current i12 is output after first increasing the drive current to the maximum level exceeding i12 and then lowering it to i12. As a result, the pressure P12 measured (step S706) after a predetermined length of time elapses (at a time point t2) is equal to the largest secondary pressure P12*b* corresponding to the maximum pump displacement θmax.

In the fourth embodiment described above, the drive current having been increased to the current level i11 corresponding to the minimum pump displacement θmin is output to the proportional electromagnetic valve 4 and the drive current having been first set to the maximum level and then decreased to the current level i12 corresponding to the maximum pump displacement θmax is output to the proportional electromagnetic valve 4. As a result, the optimal correspondence between the pressure P11 measured during the learning control to be used for reference and the minimum pump displacement θmin and between the pressure P12 measured during the learning control to be used as reference and the maximum pump displacement θmax is achieved, which, in turn, enables accurate pump displacement correction by taking into consideration the hysteresis characteristics of the proportional electromagnetic valve 4.

It is to be noted that while the displacement control signals imin and imax are respectively calculated based upon the measured pressure P11 (first measured pressure) corresponding to the minimum displacement θmin, which is detected while increasing the displacement, and the measured pressure P12 (second measured pressure) corresponding to the maximum pump displacement θmax, which is detected while decreasing the displacement in the fourth embodiment, the pressure Pa may be detected through actual measurement (step S409) to be used as a reference in the correction in a similar manner in the first embodiment as well. Namely, the displacement control signal i may be corrected based upon the measured pressure Pa detected while increasing the displacement and the measured pressure Pa detected while decreasing the displacement. In addition, as in the third embodiment, the detected pressure value Pa in the first embodiment, too, may undergo filtering processing. In such a case, it is not necessary to execute the processing in steps S410 through S413.

It is to be noted that while an explanation is given above in reference to the embodiments on examples in which the present invention is adopted in a displacement control device for controlling the displacement of the hydraulic pump 1, the present invention may also be adopted with equal effectiveness in another type of variable-displacement hydraulic device, e.g., a hydraulic motor. While the pump displacement is controlled in correspondence to the secondary pressure Pa from the proportional electromagnetic valve 4, another displacement altering means for generating a displacement control pressure may be used. For this reason, reference characteristics based upon which the displacement is controlled do not need to be those in FIGS. 9 and 18 showing the reference characteristics of the proportional electromagnetic valve 4 used as a displacement altering means in the embodiments. While the target pump displacement θ0 is set at two points (θ01, θ02) and the characteristics of the correction pressure ΔP0 are represented by the linear expression (I) in the first embodiment, the displacement θ0 to be used for reference may be set at a single point or at three or more points, and the characteristics of the correction pressure ΔP0 may be represented by an expression other than the linear expression (I). Likewise, the target pump displacement θ0 may be set at a single point or at three or more points in the third embodiment.

While the target pump displacement θ0 constituting a command value is input by generating the positive control pressure Pn in response to an operation of the operation lever 12, the target pump displacement may be input through another input means. While the pressure Pa corresponding to the target command pressure P0 is detected by using the pressure sensor 5, another pressure detecting means may be utilized.

While the target command pressure P0 corresponding to the target pump displacement θ0 is calculated based upon the predetermined characteristics in FIG. 9 and the target drive current i0 corresponding to the target pump displacement θ0 is calculated based upon the characteristics in FIG. 10 in the first embodiment, a pressure calculating means and a signal calculating means adopting structures other than those may be used instead. As long as the target drive current i0 is corrected based upon the target command pressure P0 and the actually measured pressure Pa, the contents of the processing executed in the controller 10 constituting the correcting means are not limited to those described above. In addition, while correction expression (I) is set through the learning control executed via the controller 10 and the correction pressure ΔP is calculated by the controller based upon the correction expression (I) during the standard control, the pressure characteristics setting means and the correction pressure calculating means may adopt structures other than those described above.

While the controller 10 outputs the control signals i11 and i12 corresponding to the respective target pump displacement θ0 based upon the predetermined reference characteristics f0 in FIG. 18 in the third embodiment, the signal outputting means may adopt a structure other than this. While the reference control signals iAmin and iAmax and the reference control pressures Pmin and Pmax corresponding to the reference pump displacements θmin and θmax, are stored in memory in advance, the reference control signals iAmin and iAmax and the reference control pressures Pmin and Pmax may be set through a method other than that adopted in the embodiment. For instance, a given pump displacement may be manually input as a reference pump displacement, and the controller 10, in turn, may calculate the current (design value) and the pressure (design value) corresponding to this pump displacement based upon the reference characteristics f0 and the current and the pressure thus calculated may be used as a reference control signal and a reference control pressure. As long as the control signal is corrected based upon the deviations Δimin and Δimax (current correction values) between the currents imin and imax determined in correspondence to the measured pressures P11 and P12 and the reference control signals iAmin and iAmax, the structure of the correcting means is not limited to that described in reference to the embodiment.

Namely, as long as the features and functions of the present invention are realized effectively, the present invention is not limited to the displacement control devices achieved in the individual embodiments. It is to be noted that the explanation provided above simply describes specific examples and does not impose any limitations or restrictions on the correspondence between the contents of the embodiments and the contents of the scope of patent claims in the interpretation of the present invention.

INDUSTRIAL APPLICABILITY

The present invention may be adopted in other construction machines equipped with a variable-displacement hydraulic pump or a variable-displacement hydraulic motor.

The disclosure of the following priority application is herein incorporated by reference:

Japanese Patent Application No. Japanese Patent Application No. 2004-91228

The invention claimed is:

1. A displacement control method, comprising:

a calculating step of calculating a displacement control signal for driving a proportional electromagnetic valve based on a displacement command;

an adjusting step of adjusting a displacement angle of a hydraulic device by driving the proportional electromagnetic valve with the displacement control signal calculated in the calculating step, and applying a displacement control pressure generated from the proportional electromagnetic valve to a displacement adjusting device; and a judging step of judging whether a learning control mode is selected or a normal control mode is selected, wherein the displacement control signal is calculated in the calculating step based on a required displacement control pressure, the required displacement control pressure being based on a reference characteristic representing a relationship between a required displacement control pressure required to provide a displacement angle corresponding to a displacement command and a required displacement control signal required for the proportional electromagnetic valve to generate the required displacement control pressure, the calculating step further comprises when the learning control mode is selected:

calculating based on the reference characteristic a minimum-side displacement control pressure corresponding to a minimum-side displacement control signal required to achieve a minimum-side displacement that is set in advance for learning and calculating a maximum-side displacement control pressure corresponding to a maximum-side displacement control signal required to achieve a maximum-side displacement that is set in advance for learning, detecting a pressure generated from the proportional electromagnetic valve when the proportional electromagnetic valve is driven with the minimum-side displacement control signal as a first measured pressure, detecting a pressure generated from the proportional electromagnetic valve when the proportional electromagnetic valve is driven with the maximum-side displacement control signal as a second measured pressure, calculating as learned values a first difference between the minimum-side displacement control pressure and the first measured pressure, and a second difference between the maximum-side displacement control pressure and the second measured pressure, and generating a correction characteristic representing a relationship between a correction pressure and a displacement command, based on the first difference and the second difference and the minimum-side displacement corresponding to the first measured pressure and the maximum-side displacement corresponding to the second measured pressure, the calculating step further comprises when the normal control mode is selected:

in response to an operator-generated displacement command, calculating a correction pressure based on the correction characteristic and the operator-generated displacement command, correcting a required displacement control pressure required to provide a displacement angle corresponding to the operator-generated displacement command with the correction pressure; and calculating the displacement control signal based on the corrected required displacement control pressure with reference to the reference characteristic.

2. A displacement control method according to claim 1, wherein;

when detecting the first measured pressure, the displacement control signal is increased from a minimum displacement so as to set the minimum-displacement-side control signal for learning, for use in detection of the first measured pressure; and when detecting the second measured pressure, the displacement control signal is reduced from a maximum displacement so as to set the maximum-displacement-side control signal for learning, for use in detection of the second measured pressure.

3. A displacement control device, comprising:

a calculating unit, the calculating unit calculating a displacement control signal for driving a proportional electromagnetic valve based on a displacement command; and an adjusting unit, the adjusting unit adjusting a displacement angle of a hydraulic device by driving the proportional electromagnetic valve with the displacement control signal calculated by the calculating unit, and applying a displacement control pressure generated from the proportional electromagnetic valve to a displacement adjusting device, wherein with reference to a reference characteristic representing a relationship between a required displacement control pressure required to provide a displacement angle corresponding to a displacement command and a required displacement control signal required for the proportional electromagnetic valve to generate the required displacement control pressure, the calculating unit calculates the displacement control signal based on the required displacement control pressure, wherein the calculating unit judges whether a learning control mode is selected or a normal control mode is selected, the calculating unit, based on the reference characteristic, calculates a minimum-side displacement control pressure corresponding to a minimum-side displacement control signal required to achieve a minimum-side displacement that is set in advance for learning, and a maximum-side displacement control pressure corresponding to a maximum-side displacement control signal required to achieve a maximum-side displacement that is set in advance for learning, when the learning control mode is selected, the displacement control device further comprises a pressure detector which detects a pressure generated from the proportional electromagnetic valve when the proportional electromagnetic valve is driven with the minimum-side displacement control signal as a first measured pressure, and detecting a pressure generated from the proportional electromagnetic valve when the proportional electromagnetic valve is driven with the maximum-side displacement control signal as a second measured pressure, when the learning control mode is selected, the calculating unit calculates as learned values a first difference between the minimum-side displacement control pressure and the first measured pressure, and a second difference between the maximum-side displacement control pressure and the second measured pressure, when the learning control mode is selected, the calculating unit generates a correction characteristic representing a relationship between a correction pressure and a displacement command, based on the first difference and the second difference and the minimum-side displacement corresponding to the first measured pressure and the maximum-side displacement corresponding to the second measured pressure, when the learning control mode is selected, the calculating unit calculates a correction pressure based on the correction characteristic and a displacement command when the displacement command is generated, and corrects a required displacement control pressure required to provide a displacement angle corresponding to the generated displacement command with the correction pressure, when the normal control mode is selected, and the calculating unit calculates the displacement control signal based on the corrected required displacement control pressure with reference to the reference characteristic, when the normal control mode is selected.

4. A construction machine, comprising a displacement control device according to claim 3.

* * * * *